US006872096B2

(12) United States Patent
Baker

(10) Patent No.: US 6,872,096 B2
(45) Date of Patent: Mar. 29, 2005

(54) ELECTRICAL ONE-PIECE DOUBLE-ENDED RECEPTACLE CONTACT

(75) Inventor: Robert William Baker, Kenton (GB)

(73) Assignee: Tyco Electronics UK LTD, Middlesex (GB)

( * ) Notice: Subject to any disclaimer, the term of this patent is extended or adjusted under 35 U.S.C. 154(b) by 0 days.

(21) Appl. No.: 10/460,529

(22) Filed: Jun. 12, 2003

(65) Prior Publication Data

US 2004/0106327 A1 Jun. 3, 2004

(30) Foreign Application Priority Data

Nov. 29, 2002 (GB) ..... 0227901

(51) Int. Cl.[7] ..... H01R 25/00
(52) U.S. Cl. ..... 439/654
(58) Field of Search ..... 439/654, 736, 439/409, 395, 936, 404, 403, 400, 276

(56) References Cited

U.S. PATENT DOCUMENTS

| | | | | | |
|---|---|---|---|---|---|
| 2,499,297 | A | * | 2/1950 | Buchanan | 439/723 |
| 3,380,012 | A | | 4/1968 | Moulin | 339/95 |
| 3,573,718 | A | | 4/1971 | Lightner | 339/176 |
| 4,445,747 | A | * | 5/1984 | Neidich | 439/787 |
| 4,545,638 | A | * | 10/1985 | Neidich | 439/787 |
| 4,624,518 | A | * | 11/1986 | Seidel | 439/400 |
| 4,778,404 | A | | 10/1988 | Pass | 439/387 |
| 5,006,077 | A | * | 4/1991 | Loose et al. | 439/409 |
| 5,120,245 | A | * | 6/1992 | Robertson et al. | 439/395 |
| 5,219,302 | A | * | 6/1993 | Robertson et al. | 439/404 |
| 5,415,571 | A | * | 5/1995 | Lutsch | 439/843 |
| 5,421,747 | A | * | 6/1995 | Agnihotri et al. | 439/736 |

* cited by examiner

*Primary Examiner*—Ross Gushi
*Assistant Examiner*—Phuongchi Nguyen
(74) *Attorney, Agent, or Firm*—Barley Snyder

(57) ABSTRACT

An electrical one-piece double-ended receptacle contact includes a first and a second socket contact portion at opposed axial ends of the receptacle contact for receiving a first and a second respective mating pin contact. A compliant middle portion interconnects the two socket contact portions. The tube wall has an axial slot extending over its length. A first and a second circumferential slot divide the tube length. The circumferential slots are axially spaced from each other by a middle section of the tube. Each of the circumferential slots has a first circumferential end between the middle section and the associated one of the socket contact portions, and a closed second circumferential end which has a predetermined circumferential distance from the axial slot so that the remaining wall portion between the axial slot and the closed second circumferential end of the respective circumferential slot forms a web connecting the middle section to the associated one of the socket contact portions. The axial length of the middle section and the circumferential and axial extensions of the webs are dimensioned to allow three axis compliance of the contact, at least reducing relative movements between the socket contact portions and the mated pin contacts.

16 Claims, 2 Drawing Sheets

ELECTRICAL ONE-PIECE DOUBLE-ENDED RECEPTACLE CONTACT

FIELD OF THE INVENTION

The invention is related to an electrical connector and more particularly to a double-ended receptacle contact designed for receiving a mating pin contact at each axial end and for being arranged in a connector housing.

BACKGROUND

There are applications requiring a receptacle contact that is capable of multiple mating cycles and can withstand a high number of reciprocating and/or pivoting movements of a mated pin contact, which may be caused by environmental vibrations. It is, therefore, desired to make a receptacle contact being suitable for such applications, particularly in connection with small-sized contacts having a small overall height.

U.S. Pat. No. 4,778,404 discloses a longitudinally resilient electrical terminal stamped and formed from a unitary piece of metal stock and having a butt-shaped front contacting body, an intermediate spring body and a rear body including conductor terminating means. The front contacting body is in engagement with a butt-shaped portion of a mating contact. For providing a good electrical contact, the intermediate spring body resiliently biasses the front contact body towards the mating contact. The resilient electrical terminal is received in a cylindrical cavity allowing longitudinal movement of the electrical terminal only.

U.S. Pat. No. 3,380,012 discloses a butt-type electrical contact comprising a receptacle portion for receiving a mating pin contact, and a cylindrical rotatable portion including a plurality of spiral slots spaced around its circumference so that the rotatable portion is rotatable around the longitudinal axis of the contact. Plugging the pin contact into the receptacle portion causes a rotation of the rotatable portion which results in wiping of the mated contacts. Whereas such wiping is desired in case of the contact of U.S. Pat. No. 3,380,012, it is to be avoided in the above-mentioned applications.

U.S. Pat. No. 3,573,718 discloses an electrical contact comprising a mating pin receiving portion which has spring members cooperating to resiliently engage the mating pin to form an electrical connection therebetween. The contact has a tab portion which permits easy insertion of the contact into a connector housing and support of the contact in the connector housing. After inserting the mating pin into the pin receiving section, there is no compliance of the spring members.

SUMMARY

An object of the present invention is to provide an electrical one-piece double-ended receptacle contact, preferably a small-sized contact, having a small overall height, being suitable for the above-mentioned applications.

According to a first aspect of the invention, there is provided an electrical one-piece double-ended receptacle contact made from a material having good spring properties, the contact being tubular and comprising a first and a second socket contact portion at opposed axial ends of the receptacle contact for receiving a first and a second respective mating pin contact. A compliant middle portion interconnects the two socket contact portions. The tube wall has an axial slot extending over its length. The tube length is divided by a first and a second circumferential slot. The circumferential slots are axially spaced from each other by a middle section of the tube. Each of the circumferential slots has a first circumferential end where the connection between the middle section and the associated one of the socket contact portions is interrupted in an axial direction, and a closed second circumferential end which has a predetermined circumferential distance from the axial slot so that the remaining wall portion between the axial slot and the closed second circumferential end of the respective circumferential slot forms a web connecting the middle section to the associated one of the socket contact portions. The thickness of the tube wall and the diameter and axial length of each socket contact portion are designed such that the mating pin contact with which the respective socket contact portion is to be mated is received in said socket contact portion in a resiliently compliant tight fit which substantially prevents axial movement of the respective mating pin contact relative to the associated socket contact portion upon the occurrence of axially exerted forces less than forces required for mating or unmating the mating pin contact. The axial length of the middle section and the circumferential and axial extensions of the webs are dimensioned to allow three axis compliance of the contact, at least reducing relative movements between the socket contact portions and the mated pin contacts.

In an embodiment of the invention, the circumferential slots are adjacent to an axially inner end of the respective one of the first and second socket contact portions. The axial portion of the tube which extends between the axially inner ends of the first and the second socket contact portions form the compliant middle portion.

Because of the tight fit between the socket contact portion and the mating pins, there is no or at least no substantial relative movement between the respective socket contact portion and the associated mated pin even if one of the mated pins is exposed to movements, in particular vibrations, e.g. if the connector comprising the contact of the invention is used in the automotive field, in washing machines, in portable CD players or the like. Thanks to the three axis compliance of the receptacle contact, said movements of one of the mated pins neither cause non-tolerable wear of the mated contacts nor are they transferred to the other one of the mated pins and, in turn, to the housing holding the other mated pin and to elements connected to a remote end of the other mated pin, e.g. an electrical terminal, a printed circuit board or the like.

In a preferred embodiment of the invention, the first and second webs are located at different sides of the axial slot which results in a more stable overall performance of the receptacle contact.

According to the invention, the first circumferential end of each circumferential slot is interrupted in an axial direction. This interruption can be obtained either by opening the first circumferential end of the circumferential slot into the axial slot or by leaving a wall portion between the first circumferential end of the circumferential slot and the axial slot and interrupting said wall portion by a shear along a circumferential shearing line extending through the remaining wall portion.

In the context of the present invention, the term slot means a separation the resulting two edges of which have an axial distance from each other in the relaxed state of the receptacle contact, whereas the term shear means that the two edges resulting from the separation have no axial distance from each other in the relaxed state of the receptacle contact.

An embodiment of the invention wherein the first end of each of the circumferential slots opens into the axial slot results in a high compliance of the receptacle contact in the region of said circumferential slot.

An embodiment of the invention wherein the first end of one of the circumferential slots opens into the axial slot and the first end of the other circumferential slot has a predetermined circumferential distance from the axial slot, wherein the remaining wall portion between the axial slot and the first end of said other circumferential slot is interrupted by being sheared along a circumferential shear line, provides an intact load path along the entire axial length of the receptacle contact for mating and assembly forces. In view of the fact that said remaining wall portion is sheared, there remains compliance of the receptacle contact in case of occurrence of unmating forces and other forces causing an axial elongation of the compliant middle portion of the receptacle contact whereas mating forces and other forces causing an axial compression of the compliant middle part are limited by an abutting to each other of the two edges of the shear. Thus overstressing of the receptacle contact is prevented.

In an embodiment of the invention, the closed second end of at least one of the circumferential slots and/or the first end of at least one of the circumferential slots has a rounded profile, preferably a semicircular profile, resulting in a particularly high compliance capability of the associated web and, in turn, of the contact. Moreover, the likelihood of cracks from occurring at the respective end of said circumferential slot is reduced.

In an embodiment of the invention, the tube wall has a funnel-shape bevel at a mating end of at least at one of the first and second socket contact portions, which facilitates the insertion of a mating pin contact into the associated socket contact portion of the receptacle contact.

Suitable materials for the receptacle contact of the invention are nickel silver, beryllium copper and phosphor bronze in view of their good resilient characteristics.

In an embodiment of the invention, the tube of the receptacle contact has a circular cross-section.

According to a second aspect of the invention, there is provided an electrical connector comprising an insulating connector housing including an pin enclosed in the housing, preferably by inmoulding the pin. A free end of the pin forms a first pin contact which projects into a cavity of the housing. The cavity extends in the axial direction of said pin contact, is open at a cavity front end opposed to said pin contact and is dimensioned to receive at least an axial part of the receptacle contact according to the invention. There is a radial clearance between an inner diameter of a cavity wall and the outer diameter of the receptacle contact. The clearance leaves space for the first socket contact portion and for the second socket contact portion, if also received in the cavity, to such an extent that an expansion of the diameter of the socket contact portion required for receiving the associated pin contact in a tight fit is not constricted. And the clearance is of such an extend that three axis compliance movements of the compliant middle portion of the receptacle contact are not constricted either.

In an embodiment of the invention, the connector housing is a part of a stator assembly of an electromagnetic winding.

BRIEF DESCRIPTION OF THE DRAWINGS

The invention will now be explained in more detail by way of an example, with reference to the accompanying drawings in which.

DETAILED DESCRIPTION OF THE PREFERRED EMBODIMENT

Figure 1:
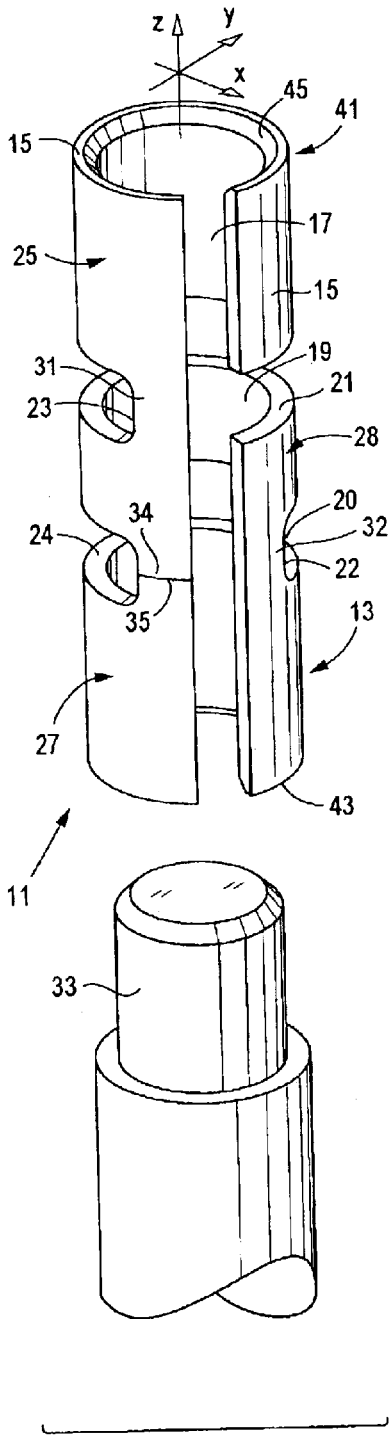
FIG. 1 is a perspective view of an embodiment of a receptacle contact according to the invention.

FIG. 1 shows an embodiment of an electrical one-piece double-ended receptacle contact 11 designed to receive a mating pin contact at each of its axial ends. The receptacle contact 11 is made from a material having good spring properties, for example nickel silver, beryllium copper, phosphor bronze or another suitable material. Contact 11 is formed as cylindrical tube 13 having a tube wall 15 which is interrupted over its length by an axial slot 17. The length of the tube 13 is divided by two circumferential slots, a first circumferential slot 19 and a second circumferential slot 20. An open first end 21 of the first circumferential slot 19 opens into the axial slot 17 and a closed second end 23 of the first circumferential slot 19 has a predetermined circumferential distance from the axial slot 17. An open first end 22 of the second circumferential slot 20 opens into the axial slot 17 and a closed second end 24 of the second circumferential slot 20 has a predetermined circumferential distance from the axial slot 17.

The circumferential slots 19 and 20 divide the tube 13 into a first socket contact portion 25 at a first axial end of the tube 13, a second socket contact portion 27 at a second axial end of the tube 13, and a compliant middle portion 28. The first socket contact portion 25 is designed to receive a first mating pin contact 29 (FIG. 2) having a substantially circular cross section and a predetermined diameter. The second socket contact portion 27 is designed to receive a second mating pin contact 33 having a substantially circular cross section and a predetermined diameter.

The first socket contact portion 25 and the compliant middle portion 28 are connected to each other by means of a solid first web 31 formed by the remaining wall portion between the axial slot 17 and the closed end 23 of the first circumferential slot 19. The second socket contact portion 27 and the compliant middle portion 28 are connected to each other by means of a solid second web 32 formed by the remaining wall portion between the axial slot 17 and the closed end 22 of the second circumferential slot 20. For the sake of symmetry or balance, it is preferred (although not absolutely necessary) to locate the first web 31 and the second web 32 at different sides of the axial slot 17.

In the embodiment shown in FIG. 1, the second circumferential slot 20 does not have an open end opening into the axial slot 17 but there remains a wall portion between the axial slot 17 and both ends of the second slot 20 forming a third web 34 at the end of the second circumferential slot 20 which is remote from the second web 32. The third web 34 is, however, divided by being sheared along a circumferential shearing line 35 axially dividing the third or sheared web 34 into two portions. These two portions may be moved away from each other by applying an axial tension force to the tube 13. As already mentioned before, the sheared web provides an intact load path for mating and assembly forces and prevents the receptacle contact from being overstressed.

Figure 2:
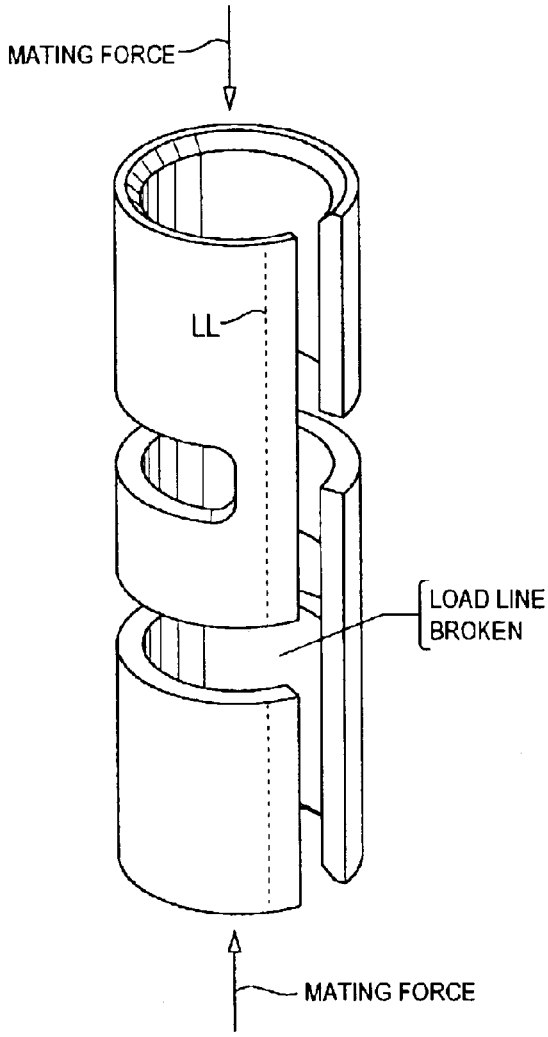
FIG. 2 is a perspective view of a modification of the receptacle contact of FIG. 1 indicating a broken load line.

In cases where such overstress protection is not needed, the shearing of the third web 34 can be replaced with an opening of second circumferential slot 20 into the axial slot 17 at the end of the circumferential slot 20 which is remote from the second web 32, i.e. by omitting third web 34 as shown in FIG. 2.

The diameter and axial lengths of the socket contact portions 25 and 27 and the thickness of the tube wall 15 are designed such that the mating pins 29 and 33 are received in the respective socket contact portion 25 and 27 in a resiliently compliant tight fit which prevents axial movement of the mating pins 29 and 33 relative to the socket contact portions 25 and 27 to a large extent. Preferably, the tight fits between the mating pins 29 and 33 and the socket contact portions 25 and 27 are designed such that relative movement between the mating pins 29 and 33 and the socket contact portions 25 and 27 occurs only when there is an axial force which is close to the force which is required for mating or unmating the mating pin 29 and/or 33.

The axial length of that part of the compliant middle portion 28 which extends between the two circumferential slots 19 and 20 is dimensioned on the one hand to allow axial resilient deformation of the part of the compliant middle portion 28 at the occurrence of axial forces which are caused by movements of the mated pin 29 and/or 33 resulting from vibrations etc. which are to be absorbed by the receptacle contact 11, and on the other hand to withstand axial forces occurring during mating and unmating the pin 29 and/or 33 without plastic deformation of the compliant middle portion 28.

The circumferential and axial extensions of the webs 31 and 32 are dimensioned to allow resilient relative movements between the socket contact portions 25 and 27 and the compliant middle portion 28 in the two axes X and Y indicated in FIG. 1, giving the contact 11 X, Y, Z compliance whereby relative movements between the socket contact portion 25 and/or 27 and the mated pin contact 29 and/or 33 are prevented or at least considerably reduced.

The closed ends 22 and 23 of the circumferential slots 19 and 20 have a semicircular profile which improves the compliance capability of the webs 31 and 32 and reduces the risk of cracks occurring at the closed ends 22 and 23 of the circumferential slots 19 and 20 in response to vibrational forces and similar forces transferred to the receptacle contact 11 via the pin 29 and/or 33.

At least one of mating ends 41 and 43 of the tube wall 15 has a funnel-shape bevel 45 facilitating the insertion of the pin 29 and/or 33 into the associated one of the socket contact portions 25 and 27.

Figure 3:
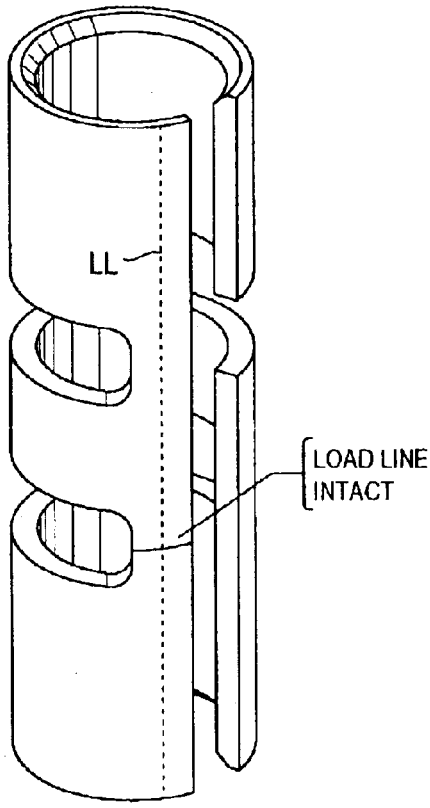
FIG. 3 is the receptacle contact of FIG. 1 indicating an intact load line.

FIGS. 2 and 3 show two embodiments which are different as to their load paths or load lines LL. The receptacle contact of FIG. 2 does not have a third web 34 but the first circumferential end of the second circumferential slot 20 opens into the axial slot 17. As a consequence, the load line LL is interrupted and the receptacle contact 11 could be overly compressed by mating forces. In the embodiment of FIG. 3, the sheared third web 34 allows an intact load line LL so that the contact 11 of FIG. 3 can withstand mating forces which the contact of FIG. 2 could not withstand without collapsing.

Figure 4:
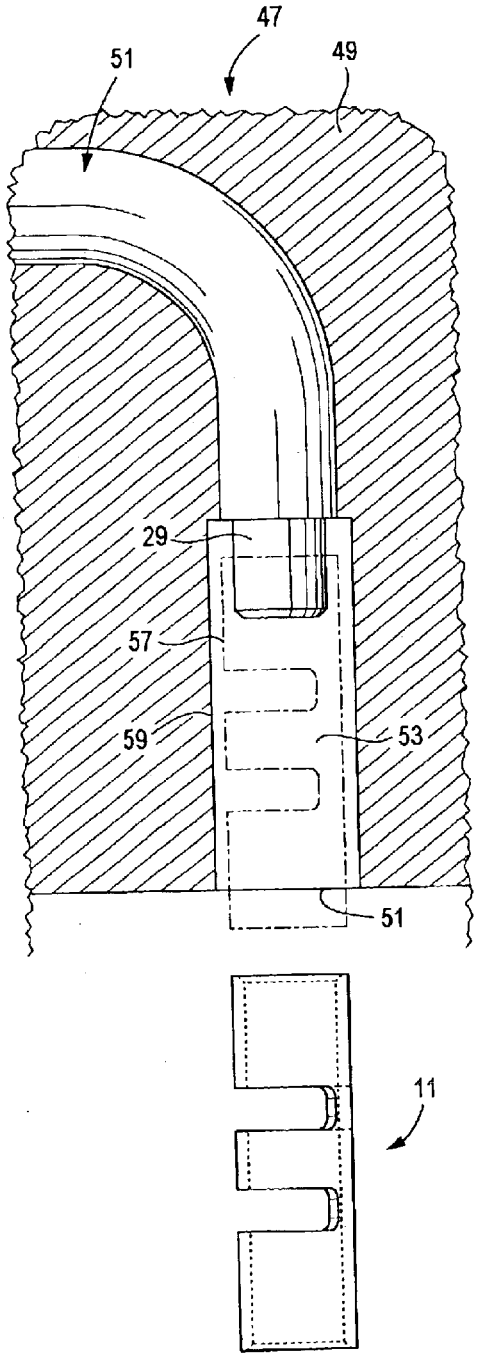
FIG. 4 is a cross-sectional view of a part of a connector housing receiving the receptacle contact of FIG. 1.

FIG. 4 shows a cross-sectional view of a part of an electrical connector 47 comprising a connector housing 49 of insulating material. A pin 51 is overmolded in the housing 49. A free end of the pin 51 forms the first pin contact 29 which projects into a cavity 53 of the housing 49. The cavity 53 extends in the axial direction of the pin contact 29. The cavity 53 is open at a cavity front end 55 which is remote from the pin contact 29. The cavity 53 is dimensioned to receive at least an axial part of the electrical receptacle contact 11 with a radial clearance 57 between an inner wall 59 of the cavity 53 and the outer diameter of the receptacle contact 1. The clearance 57 is dimensioned to leave radial space for the first socket contact portion 13 of the receptacle contact 11 to expand in diameter as required for receiving the first mating pin 29 in a tight fit and allow three axis compliance movements of the compliant middle portion 28 of the receptacle contact 1.

In a practical embodiment of the invention, the connector housing 49 may be a part of a stator assembly of an electromagnetic winding.

In a practical embodiment of the invention, the first socket contact portion 25 of the receptacle contact 11 is inserted into the cavity 53 and is mated with the pin contact 29 of the overmolded pin 51. Preferably, the entire length of the receptacle contact 11 is received in the cavity 53, including the second socket contact portion 27.

During mating of the first pin contact 29 with the first socket contact portion 25, the edges of the sheared part of the third web 34 are abutting each other to provide normal contact force without overstressing the second web 32, and the first socket contact portion 25 opens for receiving the first pin contact 29 having an outer diameter which is larger than the inner diameter of the first socket contact portion 25. This results in a desired radial contact force giving a tight fit of the first pin contact 29 in the first socket contact portion 25.

During mating of the second pin contact 33 into the second socket contact portion 27, the edges of the sheared part of the third web 34 open for receiving the pin contact 33 having an outer diameter which is larger than the inner diameter of the second socket contact portion 27. The radial contact force on the pin contact 29 in the socket contact portion 25 remains relatively constant despite the opening of the second contact portion 27.

In case of axial reciprocating movements of the second pin contact 33, the friction between the second socket contact portion 27 and the pin contact 33 causes the compliant middle portion 28 to flex by transmitting the reciprocation movements through the web 32 caused by tensile and compression forces. The second pin contact 33 and/or the first pin contact 29 will unmate when the compliant deflection load exceeds the friction between the first and/or second socket contact portion 25 and 27 and the first and/or second pin contact 29 and 33. By making the friction force between the first pin contact 29 and the first socket contact portion 25 greater than the friction force between the second pin contact 33 and the second socket contact portion 27, it can be controlled that unmating forces exerted at the the second pin contact 33 result in an unmating of the second pin contact 33 before the first pin contact 29.

In an embodiment of the invention, the one-piece receptacle contact 11 is cut or stamped from sheet metal.

One aspect of the receptacle contact 11 of the present invention are applications requiring small dimensions and, in particular, a small overall height.

The receptacle contact of the invention meets the basic requirement for a receptacle contact that is capable of multiple mating cycles. In an practical embodiment of the invention wherein the receptacle contact is made from nickel silver, the receptacle contact can tolerate $10^9$ reciprocations of 20 $\mu$m without wear occurring. Three axes compliance of the receptacle contact has advantages for the design of the assembly the receptacle contact of the invention is used in as it isolates said assembly from forces resulting from movements acting on a pin mating with the receptacle contact.

An advantage of the invention is that a solid pin can be inmolded before the attachment of the receptacle contact structure, thereby eliminating potential damage during the inmoulding process which might happen if the receptacle contact structure were provided at the pin before the immoulding process.

I claim:

1. An electrical one-piece double-ended receptacle contact made from a material having good spring properties, the contact being tubular and comprising:

first and second socket contact portions at opposed axial ends of the receptacle contact for receiving respective first and a second mating pin contacts;

a compliant middle section interconnecting the two socket contact portions;

an axial slot extending along a tube wall;

first and a second circumferential slots extending generally transverse to the axial slot, said circumferential slots being axially spaced from each other by the compliant middle section, each of said circumferential slots having a first circumferential end which separates the middle section from the associated one of the socket contact portions, and a closed second circumferential end which has a predetermined circumferential distance from the axial slot;

first and second webs respectively connecting the middle section to the associated one of the socket contact portions near the associated second circumferential end;

the axial length of the middle section and the circumferential and axial extensions of the webs being dimensioned to allow three axis compliance of the receptacle contact at least reducing relative movements between the socket contact portions and the mated pin contacts.

2. The contact of claim 1 wherein the first and second webs are located on different sides of the axial slot.

3. The contact of claim 1 wherein the first end of at least one of the circumferential slots opens into the axial slot.

4. The contact of claim 1 wherein the first end of at least one of the circumferential slots has a predetermined circumferential distance from the axial slot, and the remaining wall portion between the axial slot and the first end of said circumferential slot is separated by being sheared along a circumferential line.

5. The contact of claim 1 wherein the tube wall has a funnel-shaped bevel at a mating end of at least at one of the first and second socket contact portions.

6. The contact of claim 1 wherein the contact is formed of a material selected from the group of nickel silver, beryllium copper and phosphor bronze.

7. The contact of claim 1 wherein the tube has a circular cross-section.

8. The contact of claim 1 wherein the closed second end of at least one of the circumferential slots has a rounded profile.

9. The contact of claim 8 wherein the rounded profile is a semicircular profile.

10. The contact of claim 1 wherein the first end of at least one of the circumferential slots has a rounded profile.

11. The contact of claim 10 wherein the rounded profile is a semicircular profile.

12. The contact of claim 1 further comprising a third web connecting the middle section to the second contact portion near the first circumferential end of the second circumferential slot.

13. The contact of claim 12 wherein the third web is shared.

14. An electrical connector comprising an insulating connector housing including a pin enclosed in the housing, a free end of the pin forming a first pin contact which projects into a cavity of the housing, the cavity extending in the axial direction of said first pin contact, being open at a cavity front end opposed to said first pin contact, and being dimensioned to receive at least an axial part of an electrical receptacle contact having first and second socket contact portions being separated by a complaint middle portion, circumferential slots being axially spaced from each other by the compliant middle portion, each having a first circumferential end which separates the middle portion from the associated one of the socket contact portions forming a radial clearance to leave space for the receptacle contact to such an extent that neither an expansion of the diameter of any of the socket contact portions required for receiving the associated pin contact in a tight fit, nor three axis compliance movements of the compliant middle portion of the receptacle contact are constricted.

15. The electrical connector of claim 14 wherein said pin is over molded in the connector housing.

16. The electrical connector of claim 14 wherein the connector housing is a part of a stator assembly of an electromagnetic winding.

* * * * *